US005919000A

United States Patent [19]

Unkle

[11] Patent Number: 5,919,000

[45] Date of Patent: Jul. 6, 1999

[54] HYDRAULIC BOAT LIFT

[76] Inventor: Charles T. Unkle, Box 4733, Princeton, Fla. 33092-4733

[21] Appl. No.: 09/039,219

[22] Filed: Mar. 16, 1998

[51] Int. Cl.[6] ..... B63C 3/06

[52] U.S. Cl. ..... 405/3; 114/44

[58] Field of Search ..... 405/1, 3, 5, 6, 405/7; 114/44, 45, 48

[56] References Cited

U.S. PATENT DOCUMENTS

| | | | |
|---|---|---|---|
| 3,021,965 | 2/1962 | Harvey | 405/3 |
| 3,177,668 | 4/1965 | Schneider et al. | 405/3 |
| 3,863,890 | 2/1975 | Ruffing | 254/10 C |
| 4,195,948 | 4/1980 | Vancil | 405/3 |
| 4,895,479 | 1/1990 | Michaelsen | 405/3 |
| 5,184,914 | 2/1993 | Basta | 405/3 |
| 5,275,505 | 1/1994 | Wilcox | 405/3 |
| 5,281,077 | 1/1994 | Phillips | 414/678 |
| 5,340,082 | 8/1994 | Holloway | 254/88 |
| 5,482,401 | 1/1996 | Spisak | 405/3 |
| 5,485,798 | 1/1996 | Samoian | 114/44 |
| 5,692,857 | 12/1997 | Ness | 405/3 |

*Primary Examiner*—Tamara Graysay
*Assistant Examiner*—Frederick L. Lagman
*Attorney, Agent, or Firm*—Alvin S. Blum

[57] ABSTRACT

A hydraulic boat lift is mounted in a body of water by adjustable legs which penetrate the bottom for lateral stability. Each leg has a vertically adjustable foot to engage the bottom for maintaining a base frame horizontal. A pair of boat supporting elements are swingably mounted to the frame by pivoting rigid arms. Diagonally mounted hydraulic cylinder or cylinders driven by water pressure from a pump or municipal supply swing the support elements and a boat thereon up out of the water. A pawl on the cylinder engages recesses in the shaft of the piston to lock the elevated position. The only way to unlock is to advance the piston which forces the pawl out. The pawl must be held out while the piston is retracted. A water aspirator withdraws water from the cylinder to lower the support elements for low tide lifting.

10 Claims, 3 Drawing Sheets

HYDRAULIC BOAT LIFT

BACKGROUND OF THE INVENTION

This invention relates to means for lifting a boat out of the water on which it floats, and more particularly to a hydraulic boat lift with means for locking the lift in elevated position and for hydraulically lowering the lift.

It is often desirable for a boat owner to be able to store a boat elevated above the water to protect against attack by marine organisms and accidental sinking. It is also desirable to have a lift that can be operated without electric power for safety and because electric power may not be readily available.

Boat lifts of the prior art may rely upon the weight of the lift and boat to lower the boat and the lift until the boat floats. If the boat is launched at high tide, and returned at low tide, the lift may not be low enough for the boat to be floated onto the lift. Efforts must then be expended to further lower the lift or wait until high tide. A boat lift that relies upon continuous pressure in a hydraulic jack to keep a boat elevated may accidentally lower a boat when pressure is lost from the jack.

SUMMARY OF THE INVENTION

It is, accordingly, an object of the invention to provide a hydraulic boat lift that may be driven by the pressure in a municipal water system without any electricity. It is another object that means be provided for positively locking the elevated lift against accidental lowering. It is yet another object that means be Provided for hydraulically forcing the lift to its lowest position.

These and other objects, features and advantages of the invention will become more apparent when the detailed description is studied in conjunction with the drawings, in which like reference characters designate like elements in the various drawing figures.

DETAILED DESCRIPTION OF PREFERRED EMBODIMENTS

Figure 1:
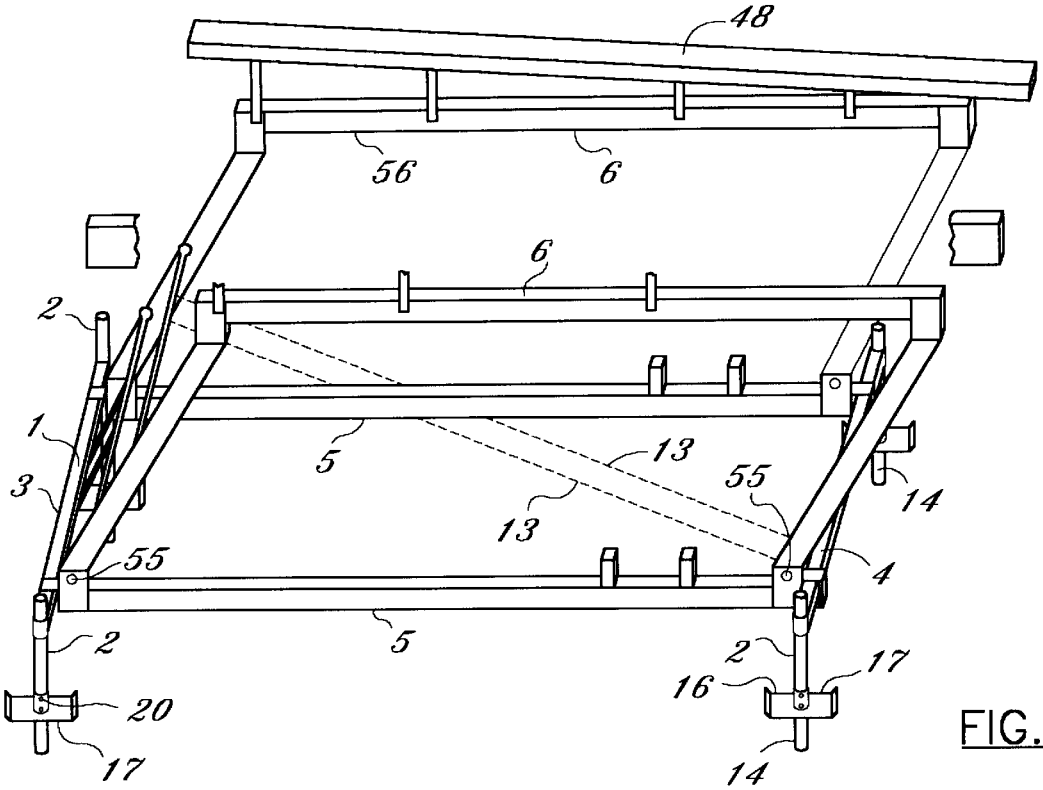
FIG. 1 is an isometric view of the boat lift with two hydraulic jacks indicated by phantom lines.
Figure 2:
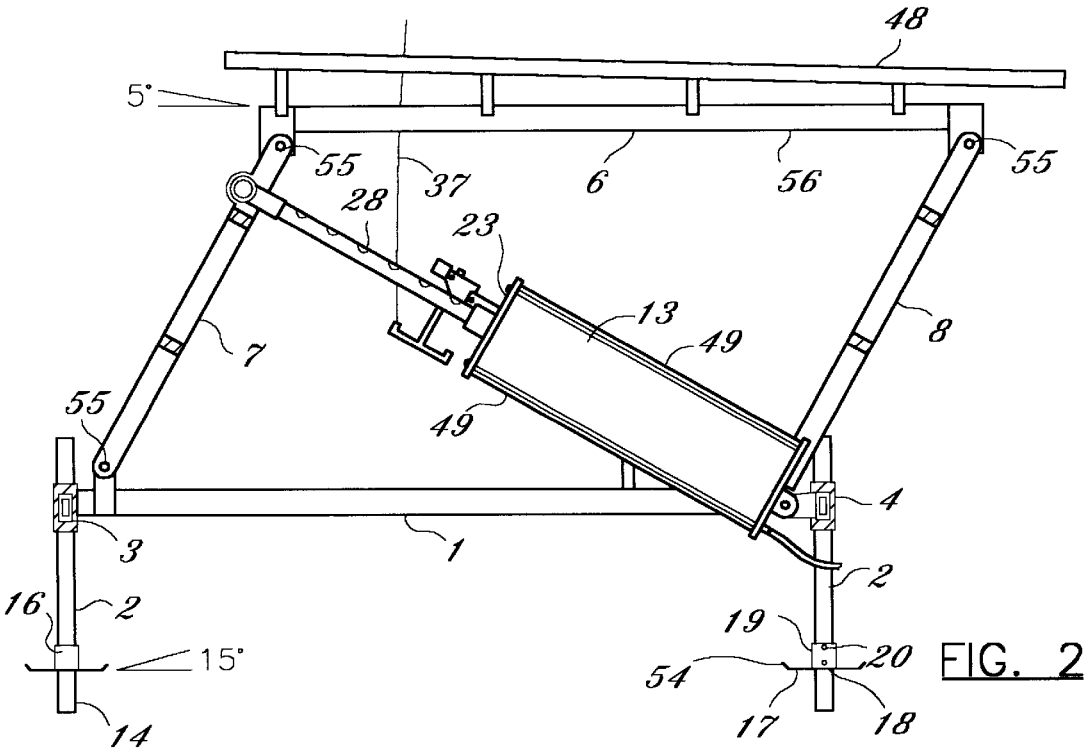
FIG. 2 is a sectional view taken on line 2—2 of FIG. 1 with hydraulic jacks in place.
Figure 3:
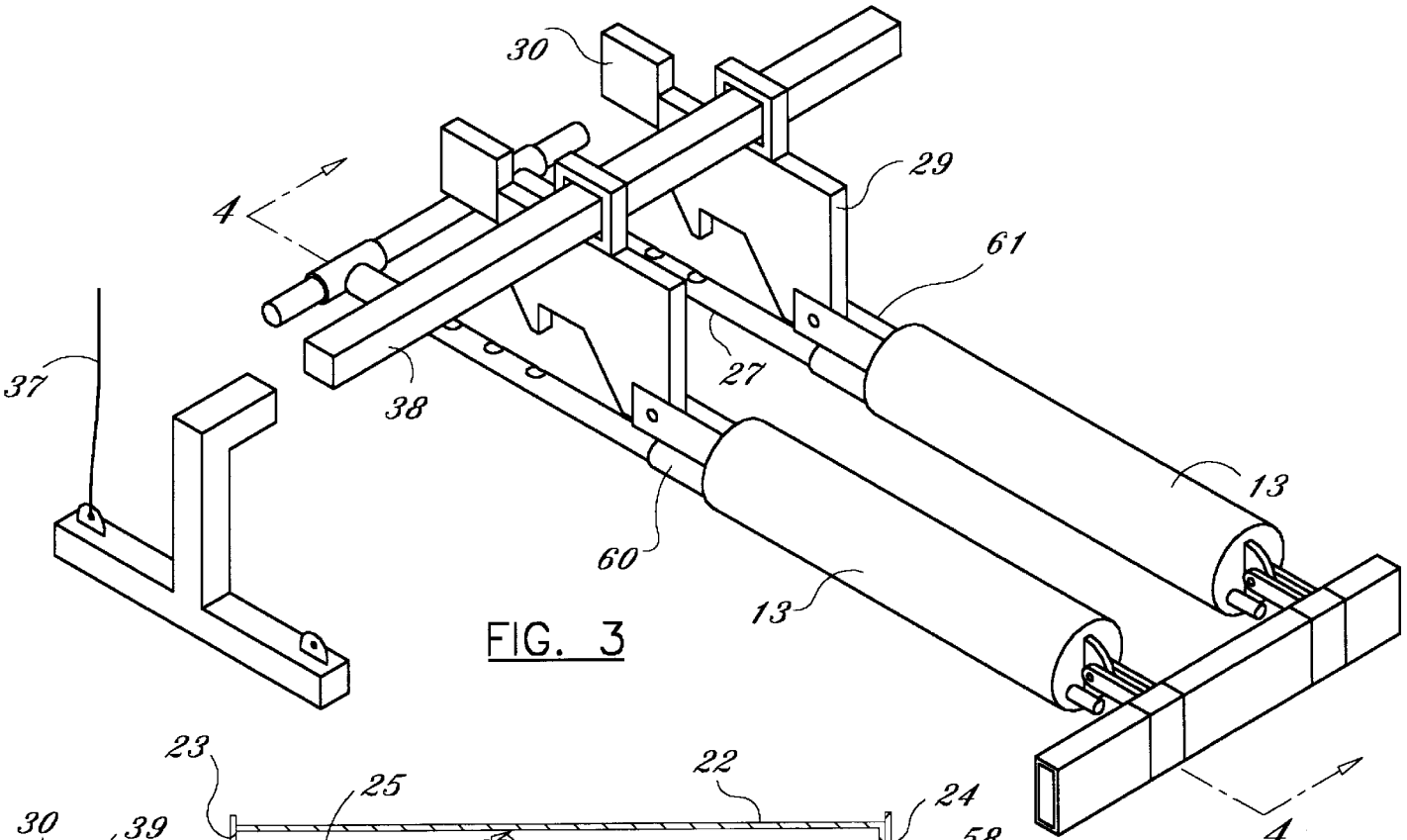
FIG. 3 is an isometric view of two hydraulic jacks of the invention side by side.
Figure 4:
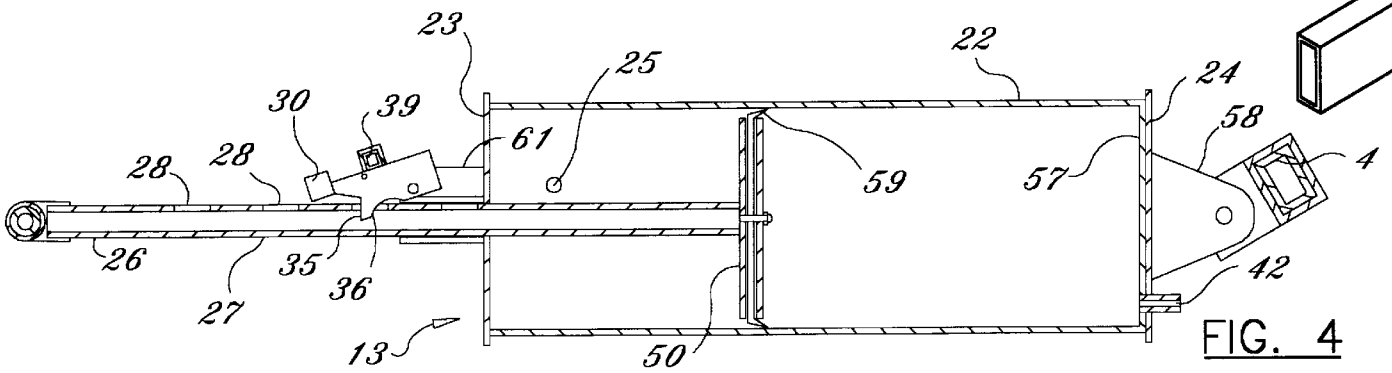
FIG. 4 is a sectional view taken through line 4—4 of FIG. 3 in the locked position.
Figure 5:
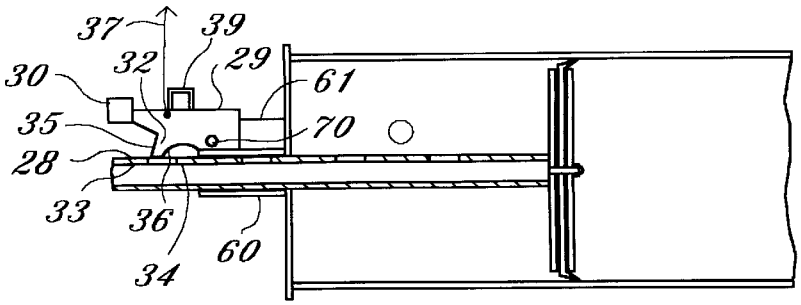
FIG. 5 is a sectional detail as in FIG. 4 with the piston advanced to unlock position.

Referring now first to FIGS. 1–5, and 7, the hydraulic boat lift of the invention comprises a base frame 1, having a front cross member 3 and a rear cross member 4 joined together by longitudinal beams 5. Vertical legs 2 extend downward from the cross members. Each leg 2 has a terminal portion 14 that is narrow in cross section for penetrating the bottom of the body of water in which the lift is installed to provide lateral stability. The leg is provided with a foot 16 having a flat horizontal bottom panel 17 with an aperture 18 and a vertical collar 19 for adjustably affixing the foot to the leg with set screws 20 at a particular elevation so that the foot rests on the bottom for vertical stability of the lift at a desired elevation. The bottom panel 16 may be provided with opposed edges 54 that are upturned at an angle of between 5° and 30°. The feet 16 are adjusted so that the base frame 1 lies in a horizontal plane parallel to the overlying water surface, even though the bottom may have an irregular surface.

A pair of parallel elongate boat support elements 6 are swingably joined to the frame by elongate rigid front arm 7 and rear arm 8 at pivots 55 to form an adjustable parallelogram with the bottom 56 of elements 6 always horizontal as diagonally extending hydraulic jack or jacks 13 change the elevation of the boat support elements 6. The boat support elements are provided with a carpet covered upper surface 48 that is tilted 5° up at the front to enhance drainage of a boat resting thereon.

The hydraulic jack 13 comprises a hydraulic cylinder assembly 21 made up of a one foot diameter polyvinylchloride cylinder 22 held between a cylinder foot 24 with gasket 57 and cylinder head 23 by threaded rods 49. Cylinder foot 24 is provided with a hose inlet 42 for application of water under pressure from a municipal water source or a water pump through a water control manifold 40. A pivotal connection 58 joins the cylinder foot to the rear cross member 4. A piston assembly 26 comprises a shaft 27 pivotally attached at its forward end to the front arm 7 and at its rear end welded to a disc 50. A rubbery cup 59 sealingly engaging the cylinder wall is attached to disc 50. An aperture 25 in the cylinder wall limits the extent the piston may be advanced. The shaft 27 is not sealed to cylinder head 23 so that the advance and retraction of the shaft is controlled by the difference in pressure between the sealed portion of the cylinder and the body of water in which the cylinder is immersed. The cylinder head 23 is provided with a cylindrical portion 60 through which shaft 27 passes and pivotal panel support 61. Shaft 27 is provided with a series of spaced apart recesses or apertures 28. A pawl 29 connected by pivot 70 to support 61 has a weight 30 attached forward of the pivot so that gravity forces it down onto shaft 27. The pawl 29 has a downwardly directed nose 32 with a slanting forward edge 35 and a slanting rear edge 36. As the shaft 27 advances when water pressure is applied to the cylinder, a recess 28 appears beneath the nose, which drops into it under gravity. Further advance causes the rear edge 34 of the recess to engage the sloping rear edge 36 of the nose which, by virtue of its angle, lifts the nose out of the recess. If pressure in the cylinder is removed, the shaft retracts under the weight of the boat, and the nose drops back into the recess. The retracting shaft presents the forward edge 33 of the recess against the forward edge 35 of the nose. The sloping angle of edge 35 is such as to prevent the pawl from being lifted out of the recess unless the shaft is advanced. In order to lower the boat and prevent the pawl from dropping into the recesses as the shaft retracts, the pawl must be held in the lifted or unlocked position by pulling on a cord 37 attached to the pawl. When multiple side by side cylinders are to be held together in unlock Position, a bar and cord holding means 38 may be provided. The bar is rectangular and fits through rectangular passages 39 on the pawls.

To lift a boat, pressure is applied to the cylinder until the recess desired for locking passes under or past the pawl. Then the pressure is released, and the shaft retracts until the pawl is locked in the recess. Pulling up on the pawl deliberately or accidentally cannot unlock the lift. To lower the boat, pressure must be applied to the cylinder until the advancing shaft lifts the pawl out of the recess. Then, holding the pawl upwards in the unlock position with holding means 38 will allow the boat to be lowered by releasing pressure in the cylinder.

In situations where there is a tidal change in water levels, the weight of the boat will force the lift down until the boat floats. If this is at high tide, and the boat returns at low tide, the lift may be too high to receive the boat if the weight of the lift alone is not enough to lower the support elements. The hydraulic control 40 provides means for applying to the cylinder water under pressure to lift the boat and suction to lower the lift as desired. A municipal pressurized water source 41 (FIG. 7) or a pump 43 taking water from the body of water supplies water under pressure to valve 44 and valve 45 which, in the positions shown, applies pressurized water to cylinder assembly 21 through inlet 42. When valve 44 is turned clockwise 90°, pressure to the cylinder is cut off. When valve 45 is then turned clockwise 90°, water in the cylinder is drained through water aspirator 46 until the pawl locks the shaft. To lower the lift to its lowermost position, the piston is advanced until the pawls are lifted to the unlocked position, the pawls are held unlocked while valve 44 is turned clockwise 270° Iron the position shown to feed the aspirator 46, and valve 45 is turned clockwise 90° from the position shown to apply suction from the water aspirator to pull water out of the cylinder.

Figure 8:
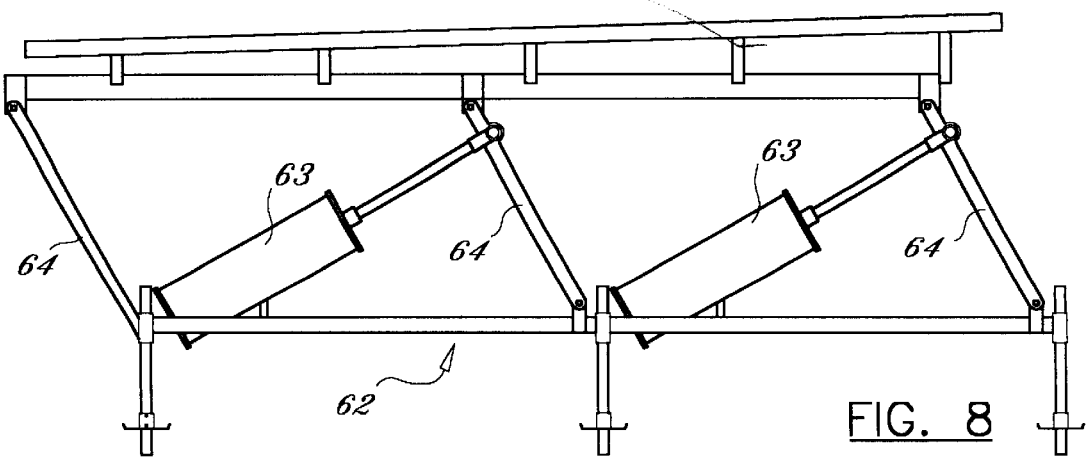
FIG. 8 is a diagrammatic side elevation view of a boat lift for a long boat having hydraulic jacks in tandem.

Long boats may be better handled with a boat lift 62 (FIG. 8) in which the hydraulic jack means comprises cylinders 63 mounted in tandem with three sets of rigid arms 64.

Figure 6:
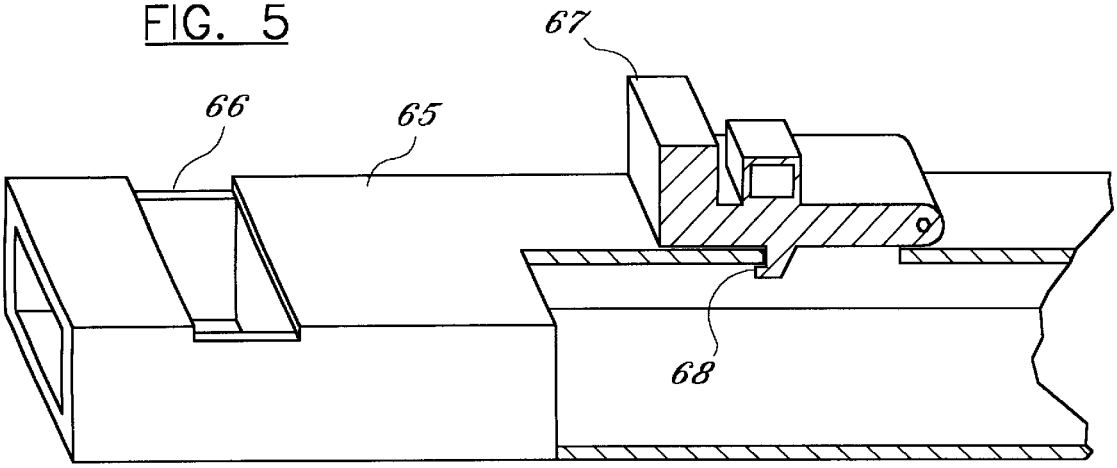
FIG. 6 is an isometric detail view, partially broken away, of another embodiment of the locking mechanism.
Figure 7:
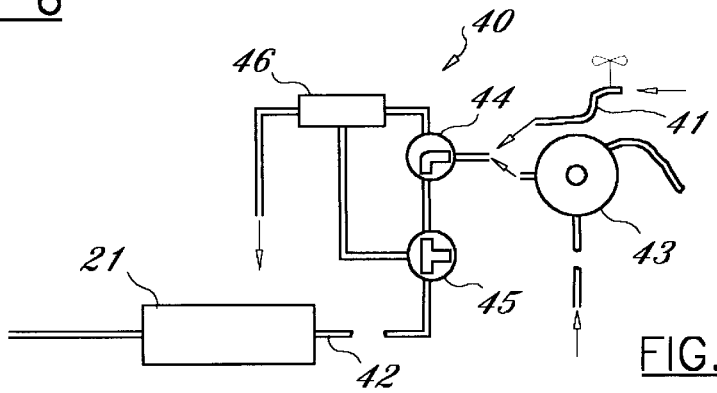
FIG. 7 is a diagrammatic representation of the hydraulic system.

FIG. 6 shows another embodiment of the locking mechanism in which the piston shaft 65 is rectangular in cross section, the recesses 66 are milled across and the pawl 67 is provided with a notched forward edge 68 on the nose that provides extra protection from accidental lifting out of the recess.

The above disclosed invention has a number of particular features which should preferably be employed in combination although each is useful separately without departure from the scope of the invention. While I have shown and described the preferred embodiments of my invention, it will be understood that the invention may be embodied otherwise than as herein specifically illustrated or described, and that certain changes in the form and arrangement of parts and the specific manner of practicing the invention may be made within the underlying idea or principles of the invention within the scope of the appended claims.

What is claimed is:

1. In a hydraulic boat lift having an elongate stationary base frame including vertical legs, front and rear cross members, and transversely spaced longitudinally extending beams fixedly joining the cross members, swingable parallel elongate boat support elements pivotally mounted toward the front and rear ends of the base frame, an elongate rigid arm pivotally connected between the front of each support element and the front of the frame and an elongate rigid arm pivotally connected between the rear of each support element and the rear of the frame, such beams, arms and support elements forming an approximate parallelogram, and water pressure jack means extending generally diagonally of such parallelogram for swinging the support elements relative to the frame so as to elevate the support elements and a boat resting thereon, the improvement comprising:

A) each vertical leg being provided with a narrow cross section, bottom-penetrating terminal portion and a foot with a flat horizontal bottom panel having an aperture passing therethrough and a vertical collar attached to and upstanding from the bottom panel such that the foot is freely slidable on the terminal portion, with the terminal portion passing through the collar and the aperture, and means for adjustably securing the collar to the terminal portion at a selected elevation such that the foot rests on the bottom of a body of water;

B) a water jack means comprising at least one water powered, hydraulic cylinder assembly comprising:

1) a cylinder with a cylinder foot and a cylinder head, the cylinder provided with an aperture toward the cylinder head for release of fluid pressure to limit piston advance;

2) a piston assembly sealingly and slideably mounted within the cylinder;

3) a piston shaft affixed to the piston assembly and extending through the cylinder head, the piston shaft being provided with a plurality of spaced apart recesses;

4) a weighted pawl pivotally attached to the cylinder head, the pawl provided with a nose arranged to cooperate with the recesses in the piston shaft such that when the piston is retracting, the nose engages a recess at a forward recess edge, being forced therein by gravity, locking the piston at a particular extension and preventing the pawl from being lifted out except by extension of the piston shaft, the nose being further arranged to cooperate with the recesses in the piston shaft such that when the piston is extending, the nose engages a recess at a rearward recess edge and forces the nose out of the recess; and 5) operator actuated holding means connected to the pawl for holding the nose out of the recesses while the piston is retracting; and C) hydraulic control means interconnected between a source of pressurized water and the at least one cylinder for providing pressurized water to the cylinder in a first mode of operation for extending the piston shaft and elevating the support elements and a boat thereon;

for maintaining the piston shaft in an extended locked position without reliance on pressure in the cylinder in a second mode of operation; and for retracting the piston shaft by aspiration of water from the cylinder in a third mode of operation.

2. The boat lift according to claim 1, in which there is a plurality of cylinders disposed side by side, and the holding means further comprises a rigid bar operatively connected to each pawl so as to hold the pawls simultaneously.

3. The boat lift according to claim 1, in which the water jack means comprises a first plurality of side by side cylinder assemblies and a second plurality of side by side cylinder assemblies ahead of said first plurality and connected in tandem for supporting a long boat.

4. The boat lift according to claim 1, in which the boat support elements are provided with upper surfaces which are tilted relative to the horizon with front ends elevated at least four inches higher than rear ends of the upper surfaces to provide drainage of a boat resting thereon.

5. The boat lift according to claim 1, in which the flat horizontal bottom panel of the foot is provided with opposed edges that are turned up at an angle of between about 5° and 30°.

6. The boat lift according to claim 1, in which the water jack means is powered by a fluid connection to a municipal water source.

7. The boat lift according to claim 1, in which the water jack means is powered by a water pump drawing water from a body of water.

8. The boat lift according to claim 1, in which an aperture in the cylinder sidewall limits advance of the piston.

9. In a hydraulic boat lift having an elongate stationary base frame including vertical legs, front and rear cross members, and transversely spaced longitudinally extending beams fixedly joining the cross members, swingable parallel elongate boat support elements pivotally mounted toward the front and rear ends of the base frame, an elongate rigid arm pivotally connected between the front of each support element and the front of the frame and an elongate rigid arm pivotally connected between the rear of each support element and the rear of the frame, such beams, arms and support elements forming an approximate parallelogram, and water pressure jack means extending generally diagonally of such parallelogram for swinging the support elements relative to the frame so as to elevate the support elements and a boat resting thereon, the improvement comprising:

A) each vertical leg being provided with a narrow cross section, bottom-penetrating terminal portion and a foot with a flat horizontal bottom panel having an aperture passing therethrough and a vertical collar attached to and upstanding from the bottom panel such that the foot is freely slidable on the terminal portion, with the terminal portion passing through the collar and the aperture, and means for adjustably securing the collar to the terminal portion at a selected elevation such that the foot rests on the bottom of a body of water;

B) a water jack means comprising at least one water powered, hydraulic cylinder assembly comprising:

1) a cylinder with a cylinder foot and a cylinder head, the cylinder provided with an aperture toward the cylinder head for release of fluid pressure to limit piston advance;

2) a piston assembly sealingly and slideably mounted within the cylinder;

3) a piston shaft affixed to the piston assembly and extending through the cylinder head, the piston shaft being provided with a plurality of spaced apart recesses;

4) a weighted pawl pivotally attached to the cylinder head, the pawl provided with a nose arranged to cooperate with the recesses in the piston shaft such that when the piston is retracting, the nose engages a recess at a forward recess edge, being forced therein by gravity, locking the piston at a particular extension and preventing the pawl from being lifted out except by extension of the piston shaft, the nose being further arranged to cooperate with the recesses in the piston shaft such that when the piston is extending, the nose engages a recess at a rearward recess edge and forces the nose out of the recess; and 5) operator actuated holding means connected to the pawl for holding the nose out of the recesses while the piston is retracting; and C) hydraulic control means interconnected between a source of pressurized water and the at least one cylinder for providing pressurized water to the cylinder in a first mode of operation for extending the piston shaft and elevating the support elements and a boat thereon; and for maintaining the piston shaft in an extended locked position without reliance on pressure in the cylinder in a second mode of operation.

10. In a hydraulic boat lift having an elongate stationary base frame including vertical legs, front and rear cross members, and transversely spaced longitudinally extending beams fixedly joining the cross members, swingable parallel elongate boat support elements pivotally mounted toward the front and rear ends of the base frame, an elongate rigid arm pivotally connected between the front of each support element and the front of the frame and an elongate rigid arm pivotally connected between the rear of each support element and the rear of the frame, such beams, arms and support elements forming an approximate parallelogram, and water pressure jack means extending generally diagonally of such parallelogram for swinging the support elements relative to the frame so as to elevate the support elements and a boat resting thereon, the improvement comprising:

A) each vertical leg being provided with a narrow cross section, bottom-penetrating terminal portion and a foot with a flat horizontal bottom panel having an aperture passing therethrough and a vertical collar attached to and upstanding from the bottom panel such that the foot is freely slidable on the terminal portion, with the terminal portion passing through the collar and the aperture, and means for adjustably securing the collar to the terminal portion at a selected elevation such that the foot rests on the bottom of a body of water;

B) a water jack means comprising at least one water powered, hydraulic cylinder assembly comprising:

1) a cylinder with a cylinder foot and a cylinder head, the cylinder provided with an aperture toward the cylinder head for release of fluid pressure to limit piston advance;

2) a piston assembly sealingly and slideably mounted within the cylinder;

3) a piston shaft affixed to the piston assembly and extending through the cylinder head, the piston shaft being provided with a plurality of spaced apart recesses;

4) a weighted pawl pivotally attached to the cylinder head, the pawl provided with a nose arranged to cooperate with the recesses in the piston shaft such that when the piston is retracting, the nose engages a recess at a forward recess edge, being forced therein by gravity, locking the piston at a particular extension and preventing the pawl from being lifted out except by extension of the piston shaft, the nose being further arranged to cooperate with the recesses in the piston shaft such that when the piston is extending, the nose engages a recess at a rearward recess edge and forces the nose out of the recess; and 5) operator actuated holding means connected to the pawl for holding the nose out of the recesses while the piston is retracting; and C) hydraulic control means interconnected between a source of pressurized water and the at least one cylinder for providing pressurized water to the cylinder in a first mode of operation for extending the piston shaft and elevating the support elements and a boat thereon;

for maintaining the piston shaft in an extended locked position without reliance on pressure in the cylinder in a second mode of operation; and for retracting the piston shaft by aspiration of water from the cylinder in a third mode of operation, and further comprising:

a plurality of cylinders disposed side by side, and the holding means further comprises a rigid bar operatively connected to each pawl so as to hold the pawls simultaneously.

* * * * *